United States Patent [19]

Rothenberg

[11] 3,932,227

[45] Jan. 13, 1976

[54] ELECTROFORMED HERMETIC GLASS-METAL SEAL

[75] Inventor: Howard S. Rothenberg, Redondo Beach, Calif.

[73] Assignee: TRW Inc., Redondo Beach, Calif.

[22] Filed: Nov. 18, 1974

[21] Appl. No.: 524,435

[52] U.S. Cl. ..... 204/16; 29/473.1; 204/40

[51] Int. Cl.[2].. C25D 5/02; C25D 5/10; B23K 31/02

[58] Field of Search ..... 204/16, 40; 29/473.1

[56] References Cited

UNITED STATES PATENTS

| | | | |
|---|---|---|---|
| 2,569,368 | 9/1951 | Bradner et al. | 204/16 |
| 3,412,455 | 11/1968 | Bronnes et al. | 29/473.1 |
| 3,415,556 | 12/1968 | Dryden | 29/473.1 |
| 3,432,913 | 3/1969 | Bronnes et al. | 29/473.1 |
| 3,632,008 | 1/1972 | Lind | 29/473.1 |
| 3,671,406 | 6/1972 | Mattia et al. | 204/16 |

*Primary Examiner*—T. M. Tufariello
*Attorney, Agent, or Firm*—Daniel T. Anderson; Stephen J. Koundakjian; Donald R. Nyhagen

[57] ABSTRACT

Disclosed is an improved method of bonding two glass-like structures or a glass-like and a metallic structure, and an improved bond which may be fabricated by this method. In the preferred embodiment, the mating surfaces are first metalized with a thin titanium layer, which is covered by a thin gold layer. The metalized surfaces are joined, and a gold layer is electro-deposited over the junction in an overlapping fashion. Finally a nickel layer is electro-deposited over the gold layer.

19 Claims, 3 Drawing Figures

ELECTROFORMED HERMETIC GLASS-METAL SEAL

BACKGROUND OF INVENTION

A. Field of the Invention

This invention relates to bonding of glass-like structures to one another and to metallic structures, particularly where hermetic sealing is desired.

B. Description of Prior Art

Numerous methods exist for forming bonds between glass-like (i.e., glass, quartz, fused silica, fused alumina and other substantially non-porous) structures to one another and to metallic structures. These previously applied methods tend to fall within three categories:

The structures may be bonded by fusing. In effect this constitutes heating the junction to a high temperature and forming a weld between the structures. While this method will produce a "clean" bond, i.e., one without contamination, it is a very high temperature process which may not always be possible. This requires close matching of coefficients of thermal expansion. Because of this the bond, once created, may not withstand thermal cycling. Also, particularly in the case where the bond is intended to create a hermetic seal for a container, the high temperatures necessary to create the bond may adversely affect the material being sealed within the container.

The bond may also be formed by soldering the two structures. Here an inter-layer is introduced between the two structures and, by application of high temperature which melts the inter-layer, the two structures are joined. This method is superior in some applications to the method employing fusing, since the inter-layer can be selected to have an intermediate coefficient of thermal expansion between the two structures, which permits a greater resistance to thermal cycling damage. However, it is also a rather high temperature process and is not, therefore, practical for many applications.

Finally, the mating surfaces of the two structures (or at least the non-metallic one(s)) may be metalized and the structures may be metallically brazed or soldered together. This presents some of the advantages of the soldering method described above, in that the solder or brazing compound selected may be of intermediate coefficient of thermal expansion. However, like the foregoing two methods, this is a rather high temperature process. Also, this method introduces the problem of flux residue and the fact that low temperature solders are not noble materials. Thus, this method is very susceptible to contamination of the joint and/or of the encapsulated material.

Numerous patents describe and claim bonding methods which attempt to overcome some of these difficulties.

In U.S. Pat. No. 3,657,076, the inventor deals with the task of bonding quartz to steel, the problem being a greatly dissimilar coefficient of thermal expansion. The method disclosed involves vacuum depositing layers of metal to the quartz, each succeeding layer being closer to the thermal expansion coefficient of steel. The final layer is electro-plated to the steel. While this method may appear to solve the thermal expansion problem, the bond would appear to have little structural integrity and, because of this inherent weakness of the bond, would probably not survive a very wide range of thermal cycling, at least if the thermal cycling were combined with mechanical stress.

U.S. Pat. No. 1,090,456 teaches a method of joining a conductor to an insulator. Here, a glass part is metalized by dipping to form a metal glaze or metallic paste fired into the surface. The metallic part is then put in contact with the metalized glass, and a thin film of metal is plated over the entire mass. This would tend to seal the glass-metal interface. However, the structure would have very little mechanical strength and would probably not survive the thermal cycling.

SUMMARY OF THE INVENTION

Accordingly, it is an object of this invention to provide a method for forming a joint between glass-like materials or between a glass-like material and metallic material which joint provides improved structural and thermal integrity and which is produced at near ambient temperatures with a minimum of contamination.

Briefly, the method involves depositing a thin film of metal (for example, titanium) having good intermolecular bonding properties with respect to the materials to be joined, the film being deposited on the mating surfaces. The first film is next covered with a second thin film of a noble metal, such as gold. The mating surfaces are placed in juxtaposition, after which a layer of noble metal (preferably, gold) is electro-plated to form the exterior of the joint, followed by a second layer of metal (such as nickel) which has the property of producing internal compression to tightly join the structure and maintain this joint over a relatively wide temperature range.

DESCRIPTION OF THE PREFERRED EMBODIMENT

Figure 1:
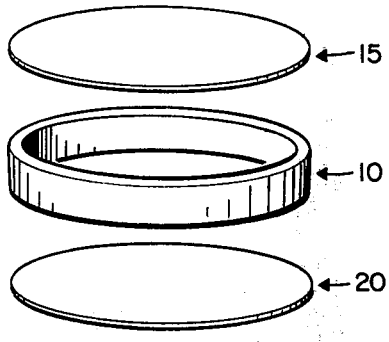
FIG. 1 is a perspective view of three workpieces to be joined by the method of the present invention.

The following description of the preferred embodiment of the present invention will be directed to a method for producing a hermetically sealed hollow cylindrical structure. As shown in FIG. 1 the structure constitutes three elemental components to be bonded together. These are the annular body 10, the disc-shaped top 15, and the disc-shaped bottom 20.

Figure 2:
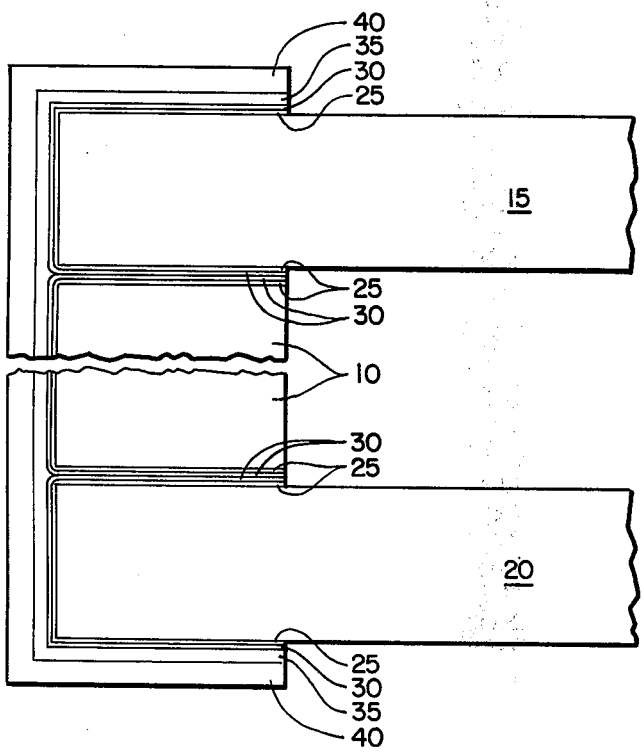
FIG. 2 is a detailed sectional view of a joint of the three workpieces in FIG. 1 produced by the preferred embodiment of the method of the present invention showing the various metallic layers constituting the joint.

A portion of the final structure of the cylinder can be seen in FIG. 2 which represents a sectional view of its peripheral region.

Prior to joining the three members, each is coated in its peripheral region with a double metallic layer, the inter layer 25 and outer layer 30 being of differing materials, as hereinafter specified. The entire structure is then placed in juxtaposition, as shown in FIG. 2, and a metallic collar 35 is applied to the entire periphery. This collar is in turn overcoated with a metallic cap 40.

Figure 3:
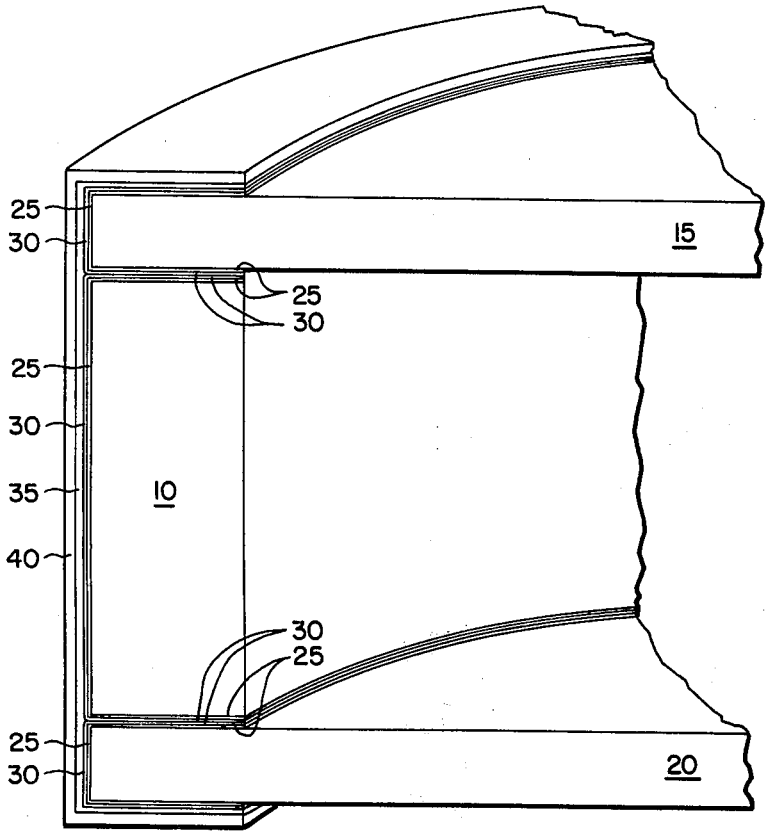
FIG. 3 is a perspective, partially sectional, view of a portion of the joint shown in FIG. 2.

The relative dimensions of the various metallic films, and, indeed, of the three component structures, have been greatly exaggerated in FIGS. 1, 2 and 3 for clarity.

In the succeeding discussion it will be assumed that the top member 15 and bottom member 20 are each composed of germanium, while the annular body 10 is composed of glass. It is to be understood that the present method can be utilized to join a wide range of glass-like materials (glass, sapphire, quartz, fused silica, fused alumina and other substantially non-porous structures) to a wide range of metallic substances or to other glass-like materials.

A preliminary step in the method is to insure that the mating surfaces are sufficiently clean to receive the initial metallic layer. One method of accomplishing this is that of ionic cleaning, i.e., placing the workpiece within an electric field so strong that discharge is set up between the electrodes and the workpiece. However, in the preferred embodiment of the present invention it is sufficient to clean the workpieces with ordinary chemical solvents.

The first metallic layer 25 is applied by vapor-phase deposition. This term is understood to include vacuum deposition, chemical vapor deposition, sputtering and ion plating, all of which are well known to those in the metalurgical art.

Of these, vacuum deposition is preferred. The workpiece is placed in a vacuum chamber and suitably masked to cause a metallic layer to be deposited onto the desired regions of the workpiece. A crucible or other suitable container of the metal to be deposited is placed in the chamber, and the chamber is evacuated. The metal is vaporized by any suitable method, preferably an electron beam, and a layer of the metal is caused to deposit onto the unmasked portions of the workpiece in a conventional manner.

The first layer 25 which is applied to all mating portions of the component structures can be composed of any metal which yields a good intermolecular bond with the material comprising the component. Titanium, chromium, molybdenum, tungsten and tantalum deposited to a thickness between 10 and 5000 angstroms is considered suitable. In the preferred embodiment a 5000 angstrom layer of titanium is applied.

The second layer 30, deposited above the first layer 25 is likewise deposited by means of vapor-phase deposition, with vacuum deposition preferred. This can be accomplished by placing a second crucible within the vacuum chamber and redirecting the electron beam to this second crucible when the second layer is to be deposited.

The second layer must be thick enough to permit electroplating thereon — 2500 angstroms being considered minimal and 3000 angstroms being considered optimal. The material comprising the layer should be a platable, ductile, noble metal, gold being preferred.

The metalized mating surfaces of the three components are then clamped in juxtaposition, and the collar 35 is formed around the periphery of the complete structure. The collar may be applied by vapor-phase deposition, although, due to its thickness (0.025 millimeters being considered minimal), electro-deposition is preferable. The material constituting the collar should, as in the case of the second layer 30, be a ductile, noble metal, preferably the same metal as that of the second layer.

In the preferred embodiment, where gold is utilized in the second layer 30, the collar 35 is likewise composed of gold. The particular plating solution should be selected for its capacity to deposit gold of high ductility and purity, but gold which is not too soft to preclude convenient handling of the structure following deposition of the collar. In the preferred embodiment a 99.9% fine, medium hard gold, such as Selrex "BDT" gold, which may be purchased commercially either as a liquid or a soluble salt, is utilized for the electro-deposition bath.

The mating surfaces are clamped in juxtaposition and placed into the plating tank. The clamped structure is connected to the current source so as to act as the cathode, while the tank contains the anodes. The gold layer constituting the collar 35 should be plated to a thickness of at least 0.025 mm, 0.05 to 0.075 mm being considered optimal.

It will be noted from FIG. 2 that the collar is caused to overlap the structure, i.e., the collar extends somewhat around the periphery of the structure in such a way that the structure is, in effect, clamped by the collar.

The final step in the method is to overlay the collar 35 with a metallic cap 40. The purpose of this cap is to exert a compressional mechanical force on the component elements of the structure, creating a tight hermetic seal. The cap may be composed of any metal which, when deposited, will exert such a compressive force, nickel being preferred.

To accomplish this step, the cap 40 is electrodeposited in the same manner as the collar 35, except that a nickel deposition solution is utilized. The preferable solution is a sulfamate nickel bath, such as those sold by Barrett. The minimum deposition thickness of this member is approximately 0.2 mm, 0.25 to 0.3 mm being considered optimal.

The completed structure comprises a hollow cylindrical device hermetically sealed by means of an overlapping peripheral metallic compressional cap 40.

I claim:

1. The method of joining a first structure, comprising a glass-like substance, to a second structure, comprising a substance selected from the group consisting of glass-like and metallic substances, comprising the following steps, each of which is performed at or near ambient temperature:

a. applying, to at least a portion of the mating surfaces of said first and second structures, a coating comprising a metallic substance capable of forming an intermolecular bond therewith;

b. covering at least a portion of said coating on each of said mating surfaces with a layer of a noble metal;

c. placing said first and second structures in juxtaposition with at least portions of their mating surfaces in contact;

d. placing a continuous overlayer of a noble metal over portions of said first and second structure, at least some of said overlayer in contact with said layers of noble metal; and e. electrodepositing a cap over at least a portion of said overlayer, said cap comprising a metal having the property of exerting a compressive force when deposited.

2. The method as recited in claim 1, wherein said step of applying comprises vapor-phase deposition.

3. The method as recited in claim 2, wherein said step of vapor-phase deposition comprises vacuum deposition.

4. The method as recited in claim 1, wherein said metallic substance is selected from the group consisting of titanium, chromium, molybdenum, tungsten and tantalum.

5. The method as recited in claim 4, wherein said metallic substance comprises titanium.

6. The method as recited in claim 1, wherein said layer of noble metal comprises gold.

7. The method as recited in claim 6, wherein said step of covering comprises vapor-phase deposition.

8. The method as recited in claim 7, wherein said step of vapor-phase deposition comprises vacuum deposition.

9. The method as recited in claim 1, wherein said overlayer of noble metal comprises gold.

10. The method as recited in claim 9, wherein said step of placing comprises electrodeposition.

11. The method as recited in claim 1, wherein the metal comprising said cap comprises nickel.

12. The method as recited in claim 1, wherein said cap is, at least in part, in overlapping relationship with at least one of said first and second structures.

13. A metallic joint between a first structure, comprising a glass-like substance, and a second structure, comprising a substance selected from the group consisting of glass-like and metallic substances, comprising:

a. a vapor-phase deposited coating applied to at least a portion of the mating surfaces of said first and second structures, said coating comprising a metallic substance capable of forming an intermolecular bond therewith;

b. a vapor-phase deposited layer covering at least a portion of said mating surfaces, said layer comprising a noble metal, at least a portion of said coating on said first structure being in juxtaposition with at least a portion of said coating on said second structure;

c. a continuous overlayer of a noble metal over portions of said first and second structure, at least some of said overlayer in contact with said layers of noble metal; and d. an electrodeposited cap over at least a portion of said overlayer, said cap comprising a metal having the property of exerting a compressive force when deposited.

14. The joint as recited in claim 13, wherein said metallic substance is selected from the group consisting of titanium, chromium, molybdenum, tungsten and tantalum.

15. The joint as recited in claim 14, wherein said metallic substance comprises titanium.

16. The joint as recited in claim 13, wherein said layer of noble metal comprises gold.

17. The joint as recited in claim 13, wherein said overlayer of noble metal comprises gold.

18. The joint as recited in claim 13, wherein said metal comprising said cap comprises nickel.

19. The joint as recited in claim 13, wherein said cap is, at least in part, in overlapping relationship with at least one of said first and second structures.

* * * * *